US009581295B2

(12) United States Patent
Gustafson

(10) Patent No.: US 9,581,295 B2
(45) Date of Patent: Feb. 28, 2017

(54) ECONOMIZER BIASING VALVE FOR CRYOGENIC FLUIDS

(75) Inventor: Erik Gustafson, Waleska, GA (US)

(73) Assignee: Chart Inc., Ball Ground, GA (US)

( * ) Notice: Subject to any disclaimer, the term of this patent is extended or adjusted under 35 U.S.C. 154(b) by 448 days.

(21) Appl. No.: 13/413,104

(22) Filed: Mar. 6, 2012

(65) Prior Publication Data

US 2013/0232997 A1 Sep. 12, 2013

(51) Int. Cl.
*F17C 7/04* (2006.01)

(52) U.S. Cl.
CPC ..... *F17C 7/04* (2013.01); *F17C 2201/0109* (2013.01); *F17C 2201/032* (2013.01); *F17C 2201/035* (2013.01); *F17C 2205/0326* (2013.01); *F17C 2205/0332* (2013.01); *F17C 2205/0335* (2013.01); *F17C 2205/0382* (2013.01); *F17C 2221/033* (2013.01); *F17C 2223/0161* (2013.01); *F17C 2223/043* (2013.01); *F17C 2223/046* (2013.01); *F17C 2227/0107* (2013.01); *F17C 2227/0393* (2013.01); *F17C 2270/0168* (2013.01)

(58) Field of Classification Search
CPC . F17C 7/02; F17C 7/04; F17C 13/02–13/028; F17C 13/002; F17C 13/04
USPC ... 62/48.1, 49.1, 49.2, 50.1, 50.2, 50.4, 50.7
See application file for complete search history.

(56) References Cited

U.S. PATENT DOCUMENTS

| | | | | |
|---|---|---|---|---|
| 2,634,947 | A * | 4/1953 | Gardner | 137/513.3 |
| 5,421,161 | A | 6/1995 | Gustafson | |
| 7,413,585 | B2 * | 8/2008 | Da Silva et al. | 48/174 |
| 8,132,558 | B2 * | 3/2012 | Lucas et al. | 123/510 |

* cited by examiner

*Primary Examiner* — Ryan J Walters
*Assistant Examiner* — Antonio R Febles
(74) *Attorney, Agent, or Firm* — Fred C. Hernandez; Mintz Levin Cohn Ferris Glovsky and Popeo, P.C.

(57) ABSTRACT

Described herein are systems and methods for cryogenic fluid delivery. The systems may include a pressure vessel containing a cryogenic fluid formed of liquid and vapor that is connected to a use device via a withdrawal line. The withdrawal line connects to the cryogenic fluid in the pressure vessel via two routes, a liquid tube and a vapor line. The vapor line may include a back-pressure regulator that opens the vapor line depending on pressure in the system. The withdrawal line may include a pressure relief valve that exerts pressure on the liquid tube. A bypass line may connect the withdrawal line to the liquid tube. The bypass line has a check valve that permits free flow of cryogen from the withdrawal line to the liquid tube via the bypass line while prohibiting cryogen flow from the pressure vessel through the bypass line. The methods employ the systems described herein.

11 Claims, 5 Drawing Sheets

ECONOMIZER BIASING VALVE FOR CRYOGENIC FLUIDS

BACKGROUND

Liquid Natural Gas (LNG) vehicle pressure vessels are widely used in heavy duty trucking operations. U.S. Pat. No. 5,421,161 describes an improved cryogenic fuel tank system. The system is particularly useful in horizontal cryogenic tanks (i.e. pressure vessels), such as those containing low-density fluids like LNG. However, while the system of the '161 patent works quite well for reducing pressure inside a pressure vessel through an economizer circuit, it actually limits the pressure vessel's ability to build pressure in mobile applications because it limits the rate of backflow of product to the vessel.

In view of the foregoing, there is a need for an improved cryogenic fuel pressure vessel system that is particularly suited for horizontal fuel pressure vessels.

SUMMARY

Described herein are systems and methods for delivering cryogenic fluid from a pressure vessel to a use device through a combination of a liquid tube, a withdrawal line, and a vapor line. In some embodiments, the system may include a pressure vessel containing a cryogen formed of a liquid and a vapor located above the liquid, a withdrawal line configured to deliver the cryogen to a use device, and a liquid tube extending into the liquid and connecting the liquid with the withdrawal line. In such embodiments, a first pressure in the pressure vessel forces liquid into the withdrawal line via the liquid tube when the withdrawal line is open. The system may further include a vapor line, extending into the vapor and connecting the vapor with the withdrawal line, and a back-pressure regulator coupled to the vapor line. In such embodiments, the back-pressure regulator opens the vapor line when a second pressure in the system exceeds a predetermined value so as to permit vapor to pass through the vapor line to the withdrawal line. The system may further include a pressure relief valve coupled to the withdrawal line, in which the pressure relief valve exerts a back pressure on the liquid tube such that a path of least resistance for cryogen out of the pressure vessel into the withdrawal line is through the vapor line whenever the pressure regulator is open. The system may also include a bypass line, connecting the withdrawal line to the liquid tube, and a check valve coupled to the bypass line, in which the check valve is configured to permit free flow of cryogen from the withdrawal line to the liquid tube and the pressure vessel via the bypass line, and in which the check valve is further configured to prohibit cryogen to flow from the pressure vessel to the withdrawal line via the bypass line.

In some embodiments, the check valve and pressure relief valve are contained in a single housing. In some such embodiments, the single housing includes the bypass line. Some embodiments may include a pressure vessel in which the pressure vessel is thermally insulated. Embodiments may include those in which the use device is a vehicle engine. In some embodiments, the pressure vessel may be mounted on a vehicle. Some embodiments may include those in which the pressure vessel is a horizontal pressure vessel. Some embodiments may include a pressure relief valve that exerts a back pressure of about 1 to 3 psi. In some embodiments, the withdrawal line includes a vaporizer for converting liquid cryogen to gas. Embodiments may also include those in which the cryogen is liquid natural gas.

Some embodiments may include a method for cryogenic fluid delivery to a gas use device in a system that includes a pressure vessel containing a cryogenic fluid formed of a liquid and a vapor. In such embodiments, the method may include permitting the cryogenic fluid to flow from the pressure vessel towards the gas use device via a withdrawal line. Further in such embodiments, the cryogenic fluid can flow from the pressure vessel to the withdrawal line through either a vapor line having a back-pressure regulator or through a liquid tube in which a first pressure in the pressure vessel forces liquid into the withdrawal line via the liquid tube when the withdrawal line is open and in which the regulator opens the vapor line when a second pressure in the system exceeds a predetermined value so as to permit vapor to pass through the vapor line to the withdrawal line. The method may further include exerting a back pressure on the liquid tube such that a path of least resistance for cryogen out of the pressure vessel into the withdrawal line is through the vapor line whenever the regulator is open. Additionally, the method may include permitting fluid in the withdrawal line to flow back into the pressure vessel via a bypass line connecting the withdrawal line to the liquid tube. In such embodiments, a check valve may be coupled to the bypass line, and the check valve is configured to permit free flow of cryogenic fluid from the withdrawal line to the liquid tube and the pressure vessel via the bypass line when a third pressure in the withdrawal line exceeds the first pressure in the pressure vessel.

Some embodiments may also include a method in which the check valve and pressure relief valve are contained in a single housing. In some such embodiments, the single housing may also include the bypass line. In some embodiments of the method, the use device may be a vehicle engine. Some embodiments may further include a pressure vessel in which the pressure vessel is mounted on a vehicle. Embodiments of the method may also include those in which the pressure vessel is a horizontal pressure vessel. In some embodiments, the cryogenic fuel delivery system further includes a control valve located along the withdrawal line. Some embodiments may include those in which the use device includes a throttle that varies a demand for cryogen by the use device. Embodiments may further include those in which the cryogen is liquid natural gas (LNG). In some embodiments, the method further includes allowing cryogenic vapor in the withdrawal tube to flow back into the pressure vessel via the vapor line. Some embodiments may include those in which the cryogenic fluid delivery system further includes a vaporizer for converting cryogenic liquid to vapor, the vaporizer located along the withdrawal line, and further in which the vaporizer imparts heat to the cryogenic fluid in the withdrawal line and allows the cryogenic fluid to expand.

DETAILED DESCRIPTION

Disclosed is a cryogenic fluid storage and delivery system. The system is primarily described herein in the context of being used for a horizontal liquid natural gas (LNG) pressure vessel that provides vehicular fuel to natural gas engines. However, it should be appreciated that the system can be used with any of a variety of mobile horizontal delivery tanks such as liquid nitrogen pressure vessels used for in-transit refrigeration. Moreover, although the disclosure is primarily described in terms of supplying fuel to an engine, it should be appreciated that the disclosed system may be configured for use with any application that uses cryogenic fluids.

Figure 1:
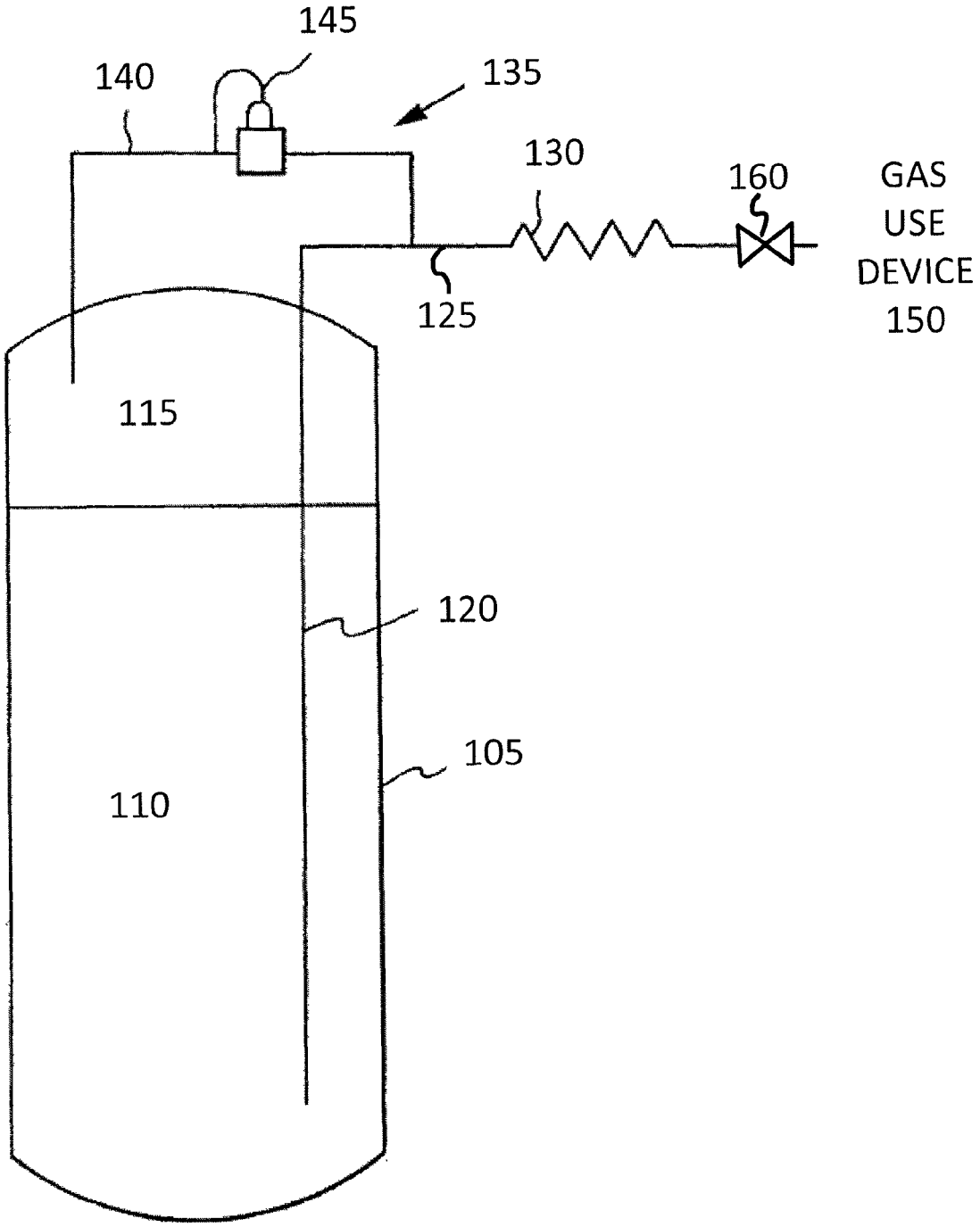
FIG. 1 shows an exemplary system diagram of a cryogenic fluid storage and delivery system with a vertical pressure vessel.

By way of background, FIG. 1 shows an example of a conventional cryogenic storage and delivery system that delivers a cryogenic fluid to a device. The system includes a pressure vessel 105, such as a large, insulated container that may vary in size. In this document, references to fuel tanks, storage tanks, containers, or the like may be considered to refer to pressure vessels. In example, the pressure vessel 105 is vertically oriented, such as about 1 to 1.5 meters (approximately 3 to 5 feet) in height. The pressure vessel 105 contains a cryogenic liquid 110. A layer of vapor 115 is located in the pressure vessel 105 above the liquid 110 in the pressure vessel 105. The vapor 115 is typically present as a result of the tank not being 100% full of liquid to allow for liquid expansion due to heat influx.

With reference still to FIG. 1, a liquid tube 120 extends into the pressure vessel 105 with a bottom end of the liquid tube 120 immersed in the cryogenic fluid 110. The liquid tube 120 communicates with a withdrawal line 125, which connects to a gas use device 150. A vaporizer 130 is positioned along the withdrawal line 125 for heating and vaporizing the liquid 110 prior to the liquid being delivered through a control valve 160 to the gas use device 150. It should be understood that in this document, the term vaporizer is used to include a heat exchanger.

A vapor line 140 also communicates with the pressure vessel 105. A bottom end of the vapor line 140 is positioned within the layer of vapor 115 above the cryogenic liquid 110. The vapor line 140 is part of an economizer circuit 135 that controls the pressure vessel's pressure. The economizer circuit 135 includes a back-pressure regulator 145 that senses the pressure within the pressure vessel and is configured to open at a predetermined pressure threshold. The vapor line 140 communicates with the withdrawal line 125 thereby providing a pathway for the vapor 115 to flow from the pressure vessel 105 to the withdrawal line 125 and ultimately to the gas use device 150. The withdrawal line 125 also allows for vapor or liquid to flow back to the pressure vessel 105 when control valve 160 is closed. To efficiently control the pressure of the pressure vessel 105, it is generally desirable to release the vapor 115 from the pressure vessel 105 during periods of use. By allowing vapor to flow into the withdrawal line, the economizer circuit 135 allows for rapid pressure reduction when the regulator 145 is open. It should be appreciated that releasing a given mass of the vapor 115 from the pressure vessel 105 results in a relieving of pressure at a much greater rate than releasing the same given mass of the liquid 110 from the tank.

The system of FIG. 1 works as follows. The cryogenic liquid 110 exits the pressure vessel 105 by passing upward through the liquid tube 120 into the withdrawal line 125. The vaporizer 130 adds heat to the liquid 110 to vaporize the liquid 110 for delivery to the gas use device 150 in gaseous form. The economizer circuit 135 provides a mechanism for releasing the vapor 115 from the pressure vessel 105, which also results in a release of pressure from the tank. In this regard, the regulator 145 opens to permit the vapor 115 to release from the pressure vessel 105 via the vapor line 140 whenever the pressure in the pressure vessel 105 exceeds the pressure level set at the regulator 145. For pressure vessels that are positioned in a vertical orientation, the vapor line 140 of the economizer circuit 135 provides the preferred path over the liquid tube 120 for release of fluid from the pressure vessel 105 whenever the regulator 145 is open. This is because lifting liquid up the long, vertical length, or height, of the liquid tube 120 provides a pressure head that resists flow of the liquid 110 out of the pressure vessel 105 via the liquid tube 120. In other words, the economizer circuit 135 provides the path of least resistance for flow of fluid out of the pressure vessel 105.

A drawback in the system of FIG. 1 arises as the vertical length of the liquid tube 120 decreases, such as in horizontal tanks where the liquid tube 120 has a much smaller height than in vertical tanks. Since the pressure head is lower for liquid tubes with shorter vertical lengths, the flow resistance provided by that the pressure head becomes negligible. As a result, the vapor line 140 may not provide the path of least resistance for flow of fluid out of the pressure vessel. In such a situation, when a demand for product is made and the regulator 145 is open, the liquid 110 may be delivered out of the pressure vessel 105 via the liquid tube 120 in place of or simultaneously with the vapor 115 being delivered out the pressure vessel 105 via the vapor line 140. In addition, a high flow demand for product has the same drawback as a short liquid tube discussed above. High flow may cause a pressure drop in the line larger than the difference in head pressure. Under such circumstances, both liquid and vapor flow simultaneously from the pressure vessel 105, and the pressure in the pressure vessel 105 cannot be quickly or effectively lowered, as in situations when vapor predominates the flow out of the pressure vessel 105.

Pressure head varies with liquid density such that a heavier liquid such as argon generates four times the head pressure of LNG at the same liquid height. Thus, the aforementioned drawbacks are more acute for light cryogens such as LNG. In a typical 3 to 5 foot tall vertical tank filled with LNG, the pressure head created in liquid tube is 1 to 2 psi Because of the head pressure in the liquid tube 120, the resistance to flow in the vapor line 140 is 1 to 2 psi lower than the resistance to flow in the liquid tube 120 such that the economizer circuit 135 will initially deliver gas to the gas use device thereby lowering the pressure in the tank until the pressure falls below the value set at the regulator at which time the regulator will close and liquid will be delivered via the liquid tube 120.

Figure 2:
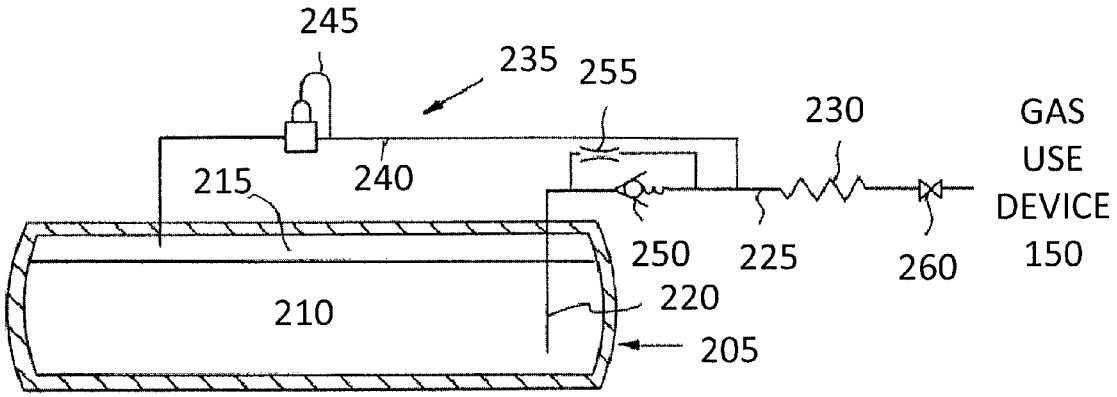
FIG. 2 shows an exemplary system diagram that includes a forwarding biasing valve and an orifice.

FIG. 2 shows an example of a partial solution to the above-mentioned drawback where the short vertical length of the liquid tube does not provide a sufficient level of pressure head to resist liquid fluid flow out of the liquid tube. As mentioned, this drawback may be present in horizontal tanks where the liquid tube has a much shorter height than in vertical tanks. The system of FIG. 2 is described in U.S. Pat. No. 5,421,161, which is incorporated herein by reference in its entirety. Horizontal pressure vessels are commonly used as fuel tanks on vehicles where the tank is mounted to the underside of the vehicle and the tank stores LNG that fuels the vehicle's engine.

With reference still to FIG. 2, the pressure vessel 205 is horizontal such that it is significantly less tall than it is long. In an example, the tank has a total height of only approximately 10 to 20 inches, significantly less than the 3 to 5 feet of some vertical pressure vessels. The pressure vessel 205 may be, for example, an insulated, double-walled structure with a vacuum layer between the walls to prevent heat from the surroundings from reaching the cryogenic fluid. As in the system of FIG. 1, the pressure vessel 205 contains a cryogenic liquid 210 and a layer of vapor 215 above the cryogenic fluid. A liquid tube 220 extends into the cryogenic liquid 210 and communicates with a withdrawal line 225 that connects to a gas use device 150. A vaporizer 230 is positioned along the withdrawal line 225 for vaporizing the fluid before it is delivered to the gas use device 150. A control valve 260 is also positioned along the withdrawal line 225. Cryogenic liquid 210 or vapor 215 is provided to the withdrawal line 225 while the control valve 260 is open. When the control valve 260 is closed, cryogenic liquid or vapor may return to the pressure vessel through orifice 255.

As shown in FIG. 2, an economizer circuit 235 provides a pathway for the vapor 215 to flow out of the pressure vessel 205. As in the system of FIG. 1, the economizer circuit 235 includes a vapor line 240 coupled to a back-pressure regulator 245. The regulator 245 opens at a predetermined pressure to permit release of the vapor 215 from the pressure vessel 205, as described above with respect to FIG. 1. The regulator 245 is reversed from the regulator 145 shown in the system of FIG. 1 such that the regulator 245 senses the pressure in the vapor line 240 rather than sensing pressure in the pressure vessel 205.

With reference still to FIG. 2, the withdrawal line 225 includes a relief valve 250 located downstream of the liquid tube 220 and upstream of the vaporizer 230. Since there is no longer a return flow path from the withdrawal line to the tank, the withdrawal line 225 also includes an orifice 255 that bypasses the relief valve 250. The relief valve 250 and orifice 255 collectively enable the system of FIG. 2 to work efficiently, as will be described in detail further below.

The system of FIG. 2 works similar to the system described with respect to FIG. 1. However, the relief valve 250 is configured to provide a predetermined level of back pressure in the liquid tube 220. It should be appreciated that any device configured to provide a level of back pressure may be used, such as, for example, a weight or an automatic valve. (Accordingly, this disclosure is not limited to the use of a pressure relief valve.) The pressure relief valve 250 thus ensures that the liquid tube 220 has a back pressure that is greater than the back pressure in the economizer circuit 235. When the regulator 245 is open, the vapor 215 will preferentially flow out of the pressure vessel 205 to the use device 150 via the economizer circuit 235, which provides the path of least resistance out of the pressure vessel 205 as a result of the back pressure in the liquid tube 220 provided by the relief valve 250. Upon closing of the regulator 245, the liquid 210 flows out of the pressure vessel 205 via the liquid tube 220 through the pressure relief valve 250 to the use device 150.

Since cryogenic fluid remains in the withdrawal line 225 when the control valve 260 closes, a return path to the tank 205 must be provided. There are two pathways to accommodate return flow to the tank: the economizer circuit 235 and the orifice 255. The primary return pathway is through orifice 255. The orifice 255 provides a free flow pathway for fluid from the withdrawal line 225 back to the pressure vessel 205 via the liquid tube 220. Since the orifice has to be small in both diameter and flow rate so as not to short circuit the function of relief valve 250, an alternative return path is also provided. In the economizer circuit 235, the regulator 245 senses the pressure in the portion of the vapor line 240 that connects to the withdrawal line 225. The regulator 245 allows return flow from the withdrawal line 225 to the tank 205 when the pressure in the withdrawal line 225 exceeds its set point. This happens when the relatively small return flow rate through the orifice 255 is exceeded by the rate of vapor generation in the vaporizer (i.e. heat exchanger) 230 and withdrawal line 225. This can happen when a large liquid flow to the use device is interrupted by the control valve 260. For example, where the system is a vehicle system, the control valve 260 may comprise a throttle valve and a throttle. Cryogenic fluid remaining in the withdrawal line 225 during transient throttle conditions such as when the throttle closes or reduces during coasting of the vehicle will cause there to be more liquid in the vaporizer 230 and withdrawal line 225 than the engine demands. Over time, the pressure within the withdrawal line 225 and vaporizer 230 may rise, such as due to vaporization of liquid remaining in the line or due to transient throttle conditions. If the rate of pressure rise exceeds the rate of pressure decay provided by return flow through the orifice 255, the line pressure will rise until it reaches the regulator set pressure, causing it to open, providing a large return flow path to the tank 205 through the regulator 245. Since the tank 205 normally operates at the set pressure of the regulator 245, the regulator will normally cycle open with every power reduction of the vehicle providing a constantly large and fast path for return flow.

The back flow of fluid from the withdrawal line 225 to the pressure vessel 205 via the regulator 245 and orifice 255 serves some useful and important purposes. For example, the backflow of fluid into the pressure vessel 205 serves to relieve pressure in the withdrawal line 225. In addition, the back flow of fluid from the withdrawal line 225 to the pressure vessel 205 also carries heat back with it to the liquid 210 in the pressure vessel 205. The return heat is absorbed by the liquid, which helps to maintain pressure in the pressure vessel 205. This pressure maintenance pathway may be highly desirable in LNG vehicles. With the proliferation of LNG vehicles, fuel stations, and engines, it has becoming increasingly common, though undesirable, to fuel a vehicle with LNG that is at a pressure lower than the pressure desired by the engine.

In operation the normal heat leak through the tank insulation, via mechanical agitation of the liquid in the tank, and the return heat flow through the orifice and regulator adds sufficient heat to maintain pressure within the pressure vessel at its operating pressure when correctly fuelled. However, if the tank's pressure is below its normal operating pressure from mis-fuelling, it requires additional heat to build the pressure in the tank back up to its normal operating pressure. Unfortunately, the system of FIG. 2 has a drawback in that in order for the orifice 255 to allow the relief valve 250 to effectively bias the pressure in the liquid tube 220, it is necessarily too small to provide a sufficient amount of backflow of heated fluid to the pressure vessel that would generate the required pressure increase within the required amount of time.

The regulator 245 setting determines the tank's normal operating pressure and is set to match the minimum pressure desired by the engine. When fuelling a tank, the fuel is normally delivered at or above this minimum pressure to ensure normal engine operation. However, if the tank is fuelled at a pressure below its normal operating pressure, it will cause operational problems. For example, if a tank with a regulator 245 setting of 100 psig is fuelled with fuel at 70 psig, the vehicle will initially run poorly because its pressure is 30 psi below the pressure required for normal operation. The vehicle's acceleration will be sluggish; it may run quite roughly and may not be able to develop full power since the tank's pressure is insufficient to deliver the fuel demand of the engine. To get the tank's operating pressure back to normal, a large heat flow to the liquid is required to cause its pressure to rise. However, since LNG tanks are designed to keep heat out, the natural pressure rise from 70 psig to 100 psig may take several days, which is undesirable. Additionally, the return flow of heat from the vaporizer 230 to the pressure vessel through the economizer circuit 235 will not occur until the withdrawal line 225 pressure has built up from 70 psig to the 100 psig setting of the regulator 245. Since much of this return flow is caused by transient throttle operation, the time it takes to build line pressure from 70 to 100 psi normally exceeds the time interval between the driver getting back onto the throttle, so much of the excess heat and pressure is simply delivered to the engine instead of the tank.

Figure 3:
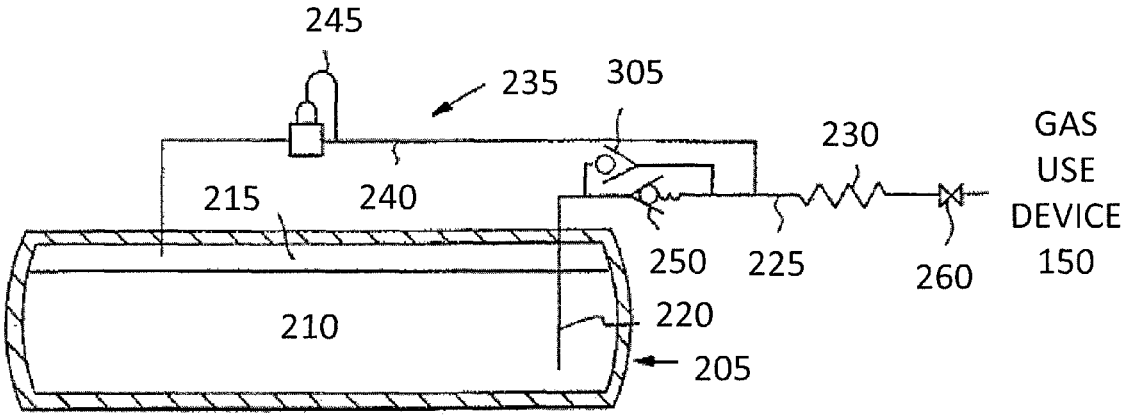
FIG. 3 shows an exemplary system that includes an integrated forward biasing valve and a check valve with reverse free-flow capabilities.

FIG. 3 shows a system that is configured to maintain functionality and safety features of the system of FIG. 2, while allowing free flow of fluid back into the pressure vessel 205. The system of FIG. 3 overcomes a problem with slow pressure rise that occurs with tanks fuelled below the proper operating pressure. With reference to FIG. 3, the system is configured in a similar manner as the system of FIG. 2. Thus, like reference numerals between FIGS. 2 and 3 refer to like components and the description of FIG. 2 applies to the system of FIG. 3.

The system of FIG. 3 includes a check valve 305 in place of the orifice 255 of the system of FIG. 2. In the forward flow direction (i.e., the direction from the pressure vessel 205 toward the gas use device 150), the check valve 305 is shut, which allows the relief valve 250 to bias the flow out of the vapor line 240 just as in the system of FIG. 2. However, the check valve 305 provides an unimpeded back flow path for liquid and vapor to return from the vaporizer 230 toward the pressure vessel 205. Since the check valve permits a free flow of vapor and liquid from the withdrawal line 225 to the pressure vessel 205, the backflow of heat to the pressure vessel is always available to assist the pressure vessel 205 in maintaining or building pressure, independent of the regulator 245 setting. This allows tanks (i.e. pressure vessels) that are mis-fuelled with low pressure fuel to quickly rebuild pressure and resume normal operation.

Figure 4:
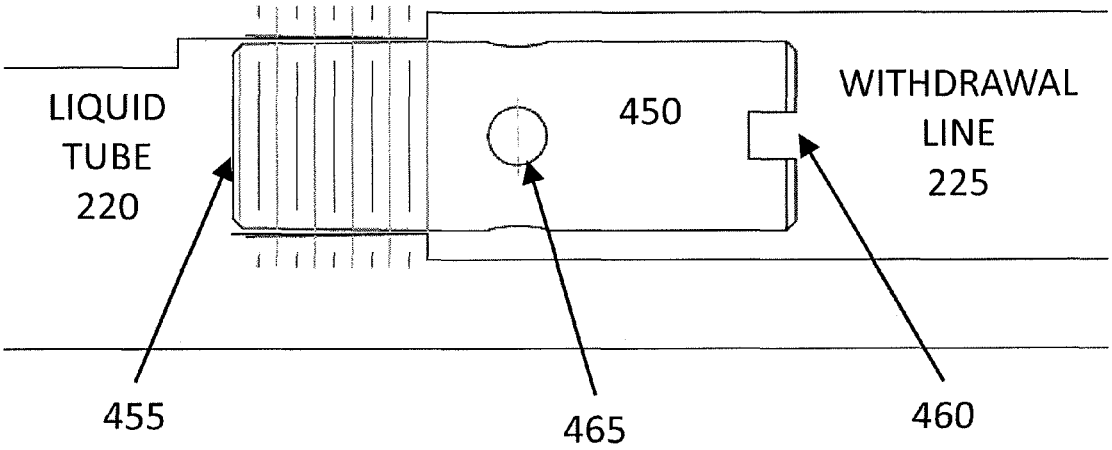
FIG. 4 shows an exemplary integrated forward biasing valve with reverse free-flow capabilities.

FIG. 4 shows an exemplary structural configuration of the relief valve 250 and check valve 305, which may both be provided in a single housing 450 that is positioned at a juncture between the liquid tube 220 and the withdrawal line 225, ahead of the vapor line 240 juncture. The housing 450 has a first port 455 for fluid to flow from the liquid tube 220 into the housing 450. The housing 450 also has a second port 460 and outlet holes 465 for fluid to flow from the housing 450 into the withdrawal line 225, or from the withdrawal line 225 into the housing 450 in the case of backflow. It should be appreciated that the configuration shown in FIG. 4 is an example and that other configurations may be used.

Figure 5:
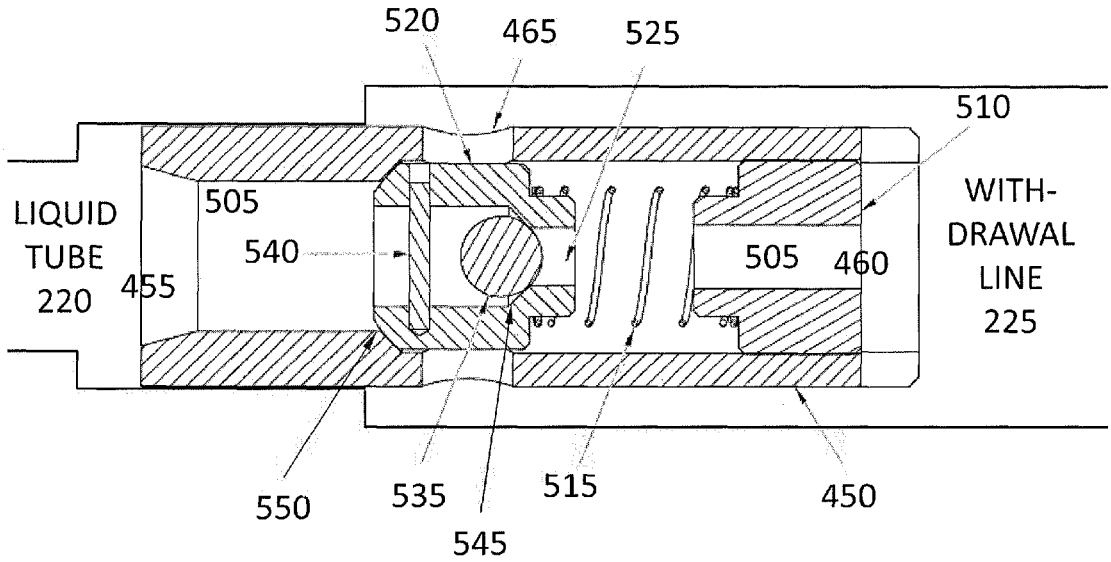
FIG. 5 shows a sectional view of an exemplary forward biasing valve with reverse free-flow capabilities.

FIG. 5 shows a cross-sectional view of the cylindrical housing 450 of FIG. 4 and provides details of an exemplary mechanism for the check valve 305 and the relief valve 250 (FIG. 3). The housing 450 defines an internal lumen 505 positioned within and along the length of the housing. The housing also includes a retainer 510, a spring 515, and outlet holes 465 and 460 that provide a pathway for fluid to flow out of or into the lumen 505. Inside the lumen 505 is a moveable check valve 520 that is adjacent to the outlet holes 465 and the spring 515 in a default state. The moveable check valve 520 includes a ball 535 and a retainer 540 to keep the ball 535 in place. In the default state, the moveable check valve 520 is positioned against a seat 550, so that it blocks flow from liquid tube 220 to withdrawal line 225.

When the cryogenic liquid 210 (FIG. 3) flows from the pressure vessel 205 (FIG. 3) to the use device 150 (FIG. 3), the liquid enters the lumen 505 from the liquid tube 220 through port 455. The liquid passes the retainer 540 and pushes the ball 535 toward and into the seat 545 of the moveable check valve 520 blocking passage 525. The spring 515 force now acts against the pressure of the liquid through the closed check valve 520 providing the necessary back pressure for the proper function of the regulator 245. Once the pressure of the liquid acting against the check valve 520 exceeds the spring force, it moves the moveable check valve 520 against the spring 515 towards the retainer 510. In this manner, the movable check valve 520 moves out of engagement with the seat 550 so that it no longer blocks flow from the liquid tube 220, allowing liquid to flow through the outlet holes 465 into the withdrawal line 225.

The mechanism shown in FIG. 5 allows for quick and relatively unimpeded flow of fluid from withdrawal line 225 (FIG. 3) to the pressure vessel 205 (FIG. 3) relative to the system of FIG. 2, which requires the liquid to flow back through the small orifice 255 or build sufficient pressure to open regulator 245. When the control valve 260 (FIG. 3) closes (or throttle is rapidly reduced), the pressure in the withdrawal line 225 will exceed the pressure in the liquid tube 220. The retainer 510 includes an opening 460 that allows flow through the retainer 510, past the spring 515, through the moveable check valve 520, past the ball 535 and retainer 540, and out the lumen 505 to the liquid tube 220 (FIG. 3). Since the pressure exerted on the movable check valve is now less than the spring force, the moveable check valve 520 moves back to the default state shown in FIG. 5 such that the moveable check valve 520 engages the seat 550. The fluid from the withdrawal line 225 flows through openings 460 & 525 and pushes the ball 535 off the seat 545 to provide an opening for fluid to flow freely around the ball. The retainer 540 keeps the ball 535 in place and allows for fluid flow around the ball 535, through the lumen 505, out of first port 455, into the liquid tube 220 (FIG. 3), and into the pressure vessel 205.

As the diameter of the lumen 505 is much greater than the orifice 255 (FIG. 2), the return of fluid through the mechanism shown in FIG. 5 is quicker and allows for more rapid transfer of heat from outside the pressure vessel 205 (FIG. 3) to the cryogenic liquid 210 (FIG. 3). Thus, the cryogenic fluid storage and delivery system has the ability to build the pressure within the pressure vessel to a desired level and then maintain that pressure with less variation. In a cryogenic fluid storage and delivery system that is used as a fuel providing system in a vehicle, this maintenance of pressure within the pressure vessel enables the vehicle to operate at proper engine efficiency and power.

The specifications of the mechanism shown in FIG. 5 may vary. Below are some exemplary mechanism specifications. In some embodiments, the mechanism shown in FIG. 5 is configured such that the force exerted by the spring 515 on the moveable check valve 520 is a set value equal to 1 to 3 psi (approximately 6.9 to 20.7 kPa). In some embodiments, the force exerted by the spring 515 is variable and may be changed to suit various requirements.

The mechanism shown in FIG. 5 is shown horizontally placed, such that the long axis of the housing 450 is parallel to the ground. In some embodiments, the housing 450 is horizontally placed, and the pressure in the withdrawal line 225 (FIG. 3) need only be slightly more than the pressure in the liquid tube 220 (FIG. 3) for fluid to flow towards the pressure vessel 205 (FIG. 3) from the withdrawal line 225 (FIG. 3). In some embodiments, the mechanism is placed such that the long axis of the housing 450 is not horizontally oriented, and the specifications of the mechanism may account for such placement.

While this specification contains many specifics, these should not be construed as limitations on the scope of an invention that is claimed or of what may be claimed, but rather as descriptions of features specific to particular embodiments. Certain features that are described in this specification in the context of separate embodiments can also be implemented in combination in a single embodiment. Conversely, various features that are described in the context of a single embodiment can also be implemented in multiple embodiments separately or in any suitable sub-combination. Moreover, although features may be described above as acting in certain combinations and even initially claimed as such, one or more features from a claimed combination can in some cases be excised from the combination, and the claimed combination may be directed to a sub-combination or a variation of a sub-combination. Similarly, while operations are depicted in the drawings in a particular order, this should not be understood as requiring that such operations be performed in the particular order shown or in sequential order, or that all illustrated operations be performed, to achieve desirable results.

Although embodiments of various methods and devices are described herein in detail with reference to certain versions, it should be appreciated that other versions, methods of use, embodiments, and combinations thereof are also possible. Therefore the spirit and scope of the appended claims should not be limited to the description of the embodiments contained herein.

What is claimed is:

1. A cryogenic fluid delivery system, comprising:

a pressure vessel containing a cryogen formed of a liquid and a vapor located above the liquid;

a withdrawal line configured to deliver the cryogen to a use device that is an engine of a vehicle;

a liquid tube extending into the liquid and connecting the liquid with the withdrawal line via a check valve assembly positioned between the liquid tube the and the withdrawal line, wherein a first pressure in the pressure vessel forces liquid into the withdrawal line via the liquid tube and the check valve assembly when the withdrawal line is open;

a vapor line extending into the vapor and connecting the vapor with the withdrawal line;

a back-pressure regulator coupled to the vapor line, wherein the back-pressure regulator opens the vapor line when a second pressure in the system exceeds a predetermined value so as to permit vapor to pass through the vapor line to the withdrawal line;

a pressure relief valve coupled to the withdrawal line, wherein the pressure relief valve exerts a back pressure on the liquid tube such that a path of least resistance for cryogen out of the pressure vessel into the withdrawal line is through the vapor line whenever the back-pressure regulator is open;

a check valve assembly that fluidly connects the liquid tube to the withdrawal line, the check valve assembly including:

(a) an outer housing formed of a cylindrical wall positioned at least partially within the withdrawal line, the cylindrical wall having a first port at a first end of the cylindrical wall that communicates directly with the liquid tube, a second port on a second, opposite end of the cylindrical wall that communicates directly with the withdrawal line, and a side outlet hole through a side of the cylindrical wall and located inside the withdrawal line, wherein the cylindrical wall defines an internal lumen that fluidly connects the liquid tube to the withdrawal line via both the side outlet hole and the second port of the cylindrical wall;

(b) a check valve housing movably mounted in the cylindrical wall and within the internal lumen, the check valve housing having an internal passageway that communicates with the internal lumen, the check valve housing movable between a default position that completely blocks the side outlet hole, and a second position that does not block the side outlet hole, and wherein the check valve housing, when in the default position, covers the side outlet hole so as to completely block fluid flow from the liquid tube to the withdrawal line via the side outlet hole when in the default position;

(c) a single spring located inside the cylindrical wall and within the internal lumen between the first port and the second port, the spring attached to the check valve housing such that the spring biases the check valve housing toward the default position; and (d) a blocking structure movably mounted in the internal passageway of the check valve housing, the blocking structure movable to a first position that completely blocks a fluid connection between the liquid tube and the second port via the internal passageway, wherein the blocking structure is free to move away from the first position when the check valve housing is in the default position to permit fluid to freely flow from the withdrawal line to the liquid tube via second port and the internal passageway of the check valve housing.

2. The system of claim 1, wherein the pressure vessel is thermally insulated.

3. The system of claim 1, wherein the pressure vessel is mounted on the vehicle.

4. The system of claim 1, wherein the pressure vessel is a horizontal pressure vessel.

5. The system of claim 1, wherein the pressure relief valve exerts a back pressure of about 1 to 3 psi.

6. The system of claim 1, wherein the withdrawal line includes a vaporizer for converting liquid cryogen to gas.

7. The system of claim 1, wherein the cryogen is liquid natural gas.

8. The system of claim 1, wherein the blocking structure is a ball.

9. The system of claim 1, wherein the cylindrical wall extends along a straight, longitudinal axis, and wherein the first port, the second port, and the spring are co-axially aligned with the longitudinal axis.

10. The system of claim 9, wherein the check valve housing moves along the longitudinal axis.

11. The system of claim 9, wherein blocking structure moves along the longitudinal axis.

* * * * *